US007996930B2

(12) United States Patent
Carter et al.

(10) Patent No.: US 7,996,930 B2
(45) Date of Patent: Aug. 16, 2011

(54) DISPOSABLE COLLAPSIBLE PORTABLE TOILET

(76) Inventors: William Carter, Warkworth (NZ); Elizabeth Carter, Warkworth (NZ)

( * ) Notice: Subject to any disclaimer, the term of this patent is extended or adjusted under 35 U.S.C. 154(b) by 247 days.

(21) Appl. No.: 12/420,281

(22) Filed: Apr. 8, 2009

(65) Prior Publication Data

US 2009/0255046 A1 Oct. 15, 2009

Related U.S. Application Data

(60) Provisional application No. 61/043,579, filed on Apr. 9, 2008.

(51) Int. Cl.
*A47K 11/06* (2006.01)

(52) U.S. Cl. ..... 4/484; 229/117.35; 220/495.11; 220/908.01; 297/440.12

(58) Field of Classification Search ..... 4/144.2, 4/452, 483, 848; 220/6, 62, 495.08, 495.11, 220/908.01; 229/117.27, 117.34, 117.35; 119/170; 297/440.12; 383/33–34.1, 104; 248/95

See application file for complete search history.

(56) References Cited

U.S. PATENT DOCUMENTS 1,955,385 A * 4/1934 Gray ..... 220/495.11
2,912,702 A * 11/1959 Mackenzie ..... 4/476
3,088,623 A * 5/1963 Parker ..... 220/324
3,159,848 A * 12/1964 Arndt, Jr. ..... 4/476
4,343,053 A 8/1982 O'Connor
4,606,080 A 8/1986 Clementino
5,155,871 A 10/1992 Sams
5,187,819 A * 2/1993 Grimes ..... 4/483
5,415,475 A 5/1995 Sandy
5,682,623 A 11/1997 Fenoglio
5,732,418 A * 3/1998 Sekitou ..... 4/449
5,749,104 A 5/1998 Evans
D402,739 S 12/1998 Mc Clements
5,978,976 A 11/1999 Chai
6,044,499 A 4/2000 Henson
6,047,414 A * 4/2000 Bailey ..... 4/484
6,079,058 A 6/2000 Green
6,081,935 A 7/2000 Kishi et al.
6,115,855 A 9/2000 Lorenzo
6,240,576 B1 6/2001 Cosby
6,385,790 B1 5/2002 Abraham et al.
6,390,323 B1 5/2002 Alticosalian
6,430,758 B1 8/2002 Cabrera
6,449,782 B1 9/2002 Jones
D464,716 S 10/2002 Gubitosi
6,523,187 B1 2/2003 Brink et al.

(Continued)

*Primary Examiner* — Robert J Canfield
(74) *Attorney, Agent, or Firm* — Mark D. Bowen, Esq.; Malin Haley DiMaggio Bowen & Lhota, P.A.

(57) ABSTRACT

A disposable portable toilet that is efficiently fabricated from foldable stock, such as corrugated cardboard, with minimal waste and adapted with a fluid absorbing inner liner is disclosed. Foldable stock material is formed as a blank sheet having a plurality of fold lines defining multiple panels disposed in side-by-side relation, and a joining tab. Each panel includes a fold-in tab that functions to provide a rim. The blank sheet provides a structure that may be configured to form a support structure that is selectively configurable from a collapsed configuration to an expanded configuration. An absorbent liner is insertedly received within the support structure. Padding sections are disposed on the liner in proximity to overlay the top rim of the support structure when the liner is received therein thereby providing the device with a padded upper rim. A drawstring functions as a closure member to close the liner after use. The present invention thus provides a disposable toilet that is particularly suited for emergency use by anyone, and particularly for use by small children while away from home.

6 Claims, 7 Drawing Sheets

U.S. PATENT DOCUMENTS

| | | | |
|---|---|---|---|
| 6,532,605 | B1 | 3/2003 | Howell |
| 6,615,416 | B1 | 9/2003 | Chapman |
| 6,647,560 | B1 | 11/2003 | Hingly et al. |
| 6,701,539 | B1 | 3/2004 | Hogan |
| 6,738,991 | B1 | 5/2004 | Dandreo et al. |
| 6,764,475 | B1 | 7/2004 | Olson |
| 6,782,565 | B2 | 8/2004 | Hinton |
| 6,783,826 | B2 | 8/2004 | Sherrod et al. |
| D508,985 | S | 8/2005 | Davis |
| 6,948,196 | B2 | 9/2005 | Hinton |
| 6,968,578 | B2 | 11/2005 | Bernsley |
| 6,986,173 | B1 | 1/2006 | Hickey |
| 7,047,573 | B2 | 5/2006 | Young |
| 7,073,212 | B1 | 7/2006 | Moffat |
| 7,086,097 | B2 | 8/2006 | Shin |
| 7,103,926 | B1 | 9/2006 | Rasberry |
| 7,131,149 | B2 | 11/2006 | Langford |
| 7,216,376 | B2 | 5/2007 | Samuels |
| 7,237,844 | B2 | 7/2007 | Stewart, III et al. |
| 7,247,360 | B1 | 7/2007 | Besner et al. |
| 7,260,855 | B2 | 8/2007 | Aycock |
| 7,290,296 | B1 | 11/2007 | Wilson |
| 7,314,967 | B2 | 1/2008 | Ashton et al. |
| 7,334,273 | B2 | 2/2008 | Thomas |
| 7,335,190 | B2 | 2/2008 | Underhill et al. |
| 2001/0034904 | A1 | 11/2001 | Phillips et al. |
| 2006/0150312 | A1 | 7/2006 | Gara et al. |
| 2007/0061951 | A1 | 3/2007 | Snider |
| 2007/0083988 | A1 | 4/2007 | Clark |
| 2007/0107116 | A1 | 5/2007 | Zamberlan et al. |
| 2007/0151009 | A1 | 7/2007 | Conrad, III et al. |
| 2007/0233028 | A1 | 10/2007 | Roe et al. |
| 2008/0022445 | A1 | 1/2008 | Sell |

* cited by examiner

DISPOSABLE COLLAPSIBLE PORTABLE TOILET

CROSS REFERENCE TO RELATED APPLICATIONS

This application claims the benefit of provisional U.S. Patent Application Ser. No. 61/043,579, filed on Apr. 9, 2008.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates generally portable toilets, and more particularly to a compact disposable portable toilet configurable from a compact configuration for storage to an expanded configuration for use.

2. Description of Related Art

There has long existed a need for a disposable portable toilet for use by individuals not having immediate access to restroom facilities. This need has been recognized in the art. For example, U.S. Pat. No. 4,606,080 issued to Clementino discloses a portable toilet comprised of a barrel-shaped stool formed of split cylinders that are detachable mounted at their top ends by an annular seat. A flexible disposable liner is suspended within the stool with the upper end of the liner captured at the upper rim. That device, however, is overly complex and is burdened by high material and fabrication costs. U.S. Pat. No. 5,682,623, issued to Fenoglio, discloses a portable, collapsible toilet made of a blank of foldable material wherein the blank includes a row of side-by-side panels connected by fold lines to define front, rear, and opposing side panels. A top panel is provided with an opening to form an integral lid. The Fenoglio device, however, provides a complex blank which results in excessive waste when fabricated thereby increasing the cost of manufacture.

Accordingly, there exists a need in the art for an improved disposable portable toilet for use by individuals not having ready access to restroom facilities.

BRIEF SUMMARY OF THE INVENTION

The present invention overcomes the limitations and disadvantages present in the art by providing an improved disposable portable toilet that is efficiently fabricated from foldable stock, such as corrugated cardboard, with minimal waste. In accordance with the present invention, foldable stock material is formed as a blank sheet having a plurality of fold lines defining multiple panels disposed in side-by-side relation, and a joining tab. Each panel includes a fold-in tab that functions to provide a rim. The blank sheet provides a structure that may be configured to form a support structure that is selectively configurable from a collapsed configuration to an expanded configuration. In the expanded configuration, the tabs are folded inwardly to form a top rim of increased thickness thereby providing additional rigidity and comfort. An absorbent liner is provided for insertion within the support structure. The liner preferably includes an absorbent base, side walls extending upward from the base to an open top adapted with a drawstring, however, the user of non-absorbent liners is also contemplated. In a preferred embodiment the liner side walls are selectively adapted with padding sections disposed in proximity to the top thereof, which padding is positioned to overlay the top rim of the hexagonal support structure when the liner is received therein thereby providing the device with a padded upper rim. In an alternate embodiment, padding sections may be incorporated directly on the support structure in lieu of the liner. The liner draw string functions as a closure member to close the liner after use. The present invention thus provides a disposable toilet that is particularly suited for emergency use by anyone, and particularly for use by small children while away from home.

Accordingly, it is an object of the present invention to provide an improved portable toilet.

Another object of the present invention is to provide an inexpensive disposable portable toilet.

Still another object of the present invention to provide a disposable portable toilet that may be easily and rapidly deployed for use from a compact configuration.

In accordance with these and other objects, which will become apparent hereinafter, the instant invention will now be described with particular reference to the accompanying drawings.

DETAILED DESCRIPTION OF THE INVENTION

Figure 1:
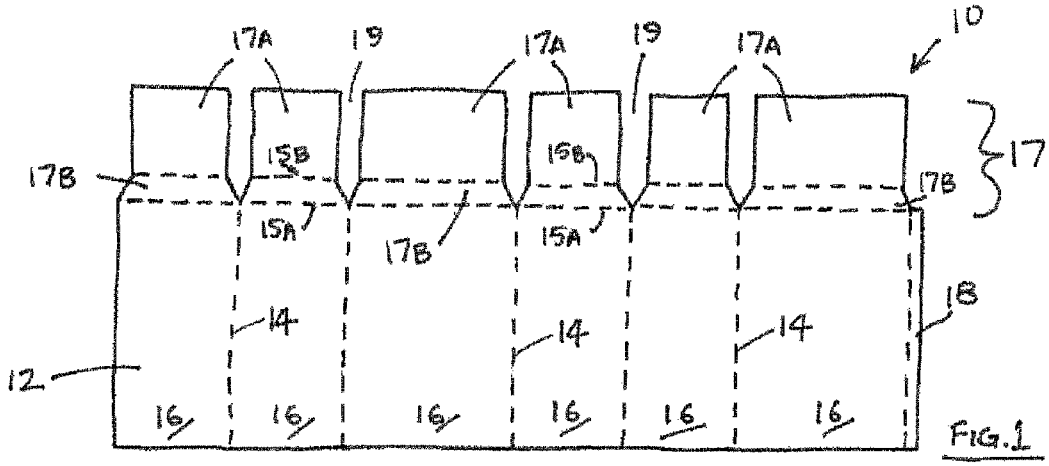
FIG. 1 is a side view of a blank of foldable material formed in accordance with the present invention.
Figure 2:
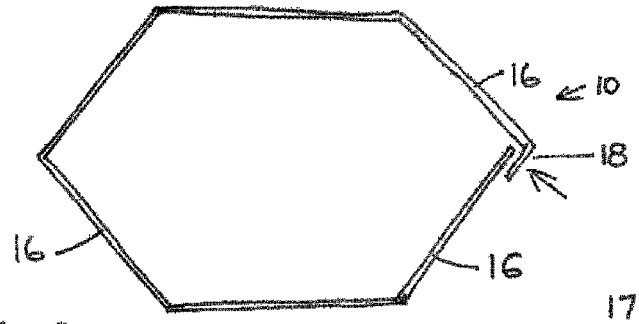
FIG. 2 is a top view of the blank configured to form an hexagonal support structure.
Figure 3:
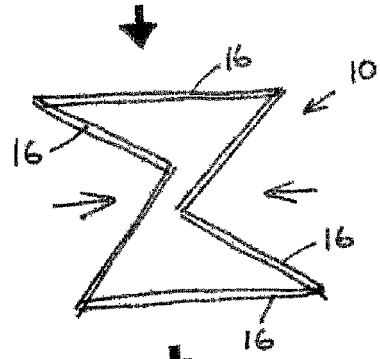
FIGS. 3 and 4 are top views illustrating collapsing the support structure to a compact configuration.
Figure 4:
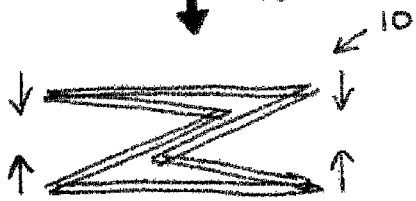

With reference now to the drawings, FIGS. 1-14 illustrate a preferred embodiment of a compact disposable portable toilet, generally referenced as 10, in accordance with the present invention. Portable toilet 10 comprises an improved disposable portable toilet that is efficiently fabricated from foldable stock material 12, such as corrugated cardboard, with minimal waste. As best illustrated in FIGS. 1-6, foldable stock material 12 is formed as a blank sheet having a plurality of fold lines 14, 15A, and 15B defining six side-by-side panels 16 and a joining tab 18. As seen in FIG. 1, waste is minimized as compared with prior art devices as the overall shape of stock material 12 is generally rectangular and cutout portions or gaps formed therein are relatively small in comparison. In a preferred embodiment six panels are used such that the support structure is hexagonal, however, the present invention contemplates alternate embodiments wherein different numbers of panels are used to form alternate support structure shapes within the scope of the present invention. Panels 16 are depicted as being of generally non-equal size (e.g. width) so as to form the structure as depicted in FIG. 2, collapsible as shown in FIGS. 3 and 4. It should be noted, however, that the present invention contemplates panel configuration wherein panels are of equal or non-equal dimension with corresponding resulting alternate structures all falling within the scope of the present invention. Each panel 16 includes a fold-in tab 17, including sections 17A and 17B, that functions to provide a rim when folded along fold lines 15A and 15B as more fully discussed herein below. As best illustrated by FIGS. 2-4, foldable stock 12 is initially formed as a blank sheet that may be configured to form a hexagonal support structure that is selectively configurable between an expanded configuration (shown in FIG. 2) to a collapsed configuration as illustrated by FIGS. 3 and 4. By varying the panel widths certain panels 16 fold concavely inward in overlapping relation thereby minimizing the folded size of the apparatus as particularly illustrated in FIGS. 3 and 4.

Figure 5:
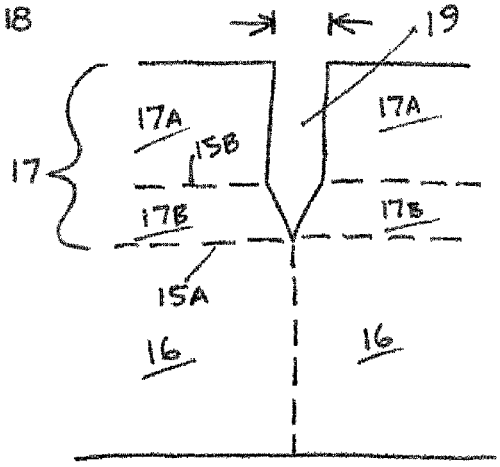
FIG. 5 is a partial side detail view of a slit formed between two adjacent tabs on the blank shown in FIG. 1.
Figure 6:
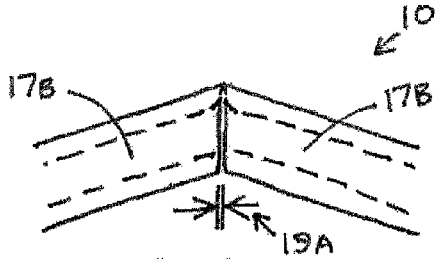
FIG. 6 is a partial top detail view thereof in when formed in an hexagonal configuration with the tabs folded over detailing the gap formed between adjacent tabs.

FIGS. 5 and 6 illustrate adjacent panels 16 and fold-in tabs 17 separated by a slit or gap 19 defined in stock material 12. Gap 19 is preferably generally rectangular with a pointed end as best illustrated in FIG. 5. As best seen in FIG. 6, the gaps 19 formed between the fold-in tabs 17A and 17B function in defining the overall shape of the support structure when in the expanded configuration, and further function to maintain the support structure in the expanded configuration by forming a top rim as illustrated in FIG. 6. In the preferred embodiment, gaps 19A are sized such that the tab edges abut when folded over with the support structure in the expanded configuration. Providing fold in tabs 17A and 17B defined by horizontal fold lines 15A and 15B results in increasing the upper rim width as section 17B forms the upper surface of the rim while section 17A is folded over and down so as to be in generally parallel relation with panel 16. As should be apparent forming the gaps larger will allow the panels to assume reduced angular deformation in relation to the inner angle, while forming the gaps smaller will allow the panels to assume increased angular deformation. As should now be apparent the overall shape of the support structure may be altered by varying the number of panels 16 and size of the gaps 19 formed between upper panel tabs 17. Accordingly, any suitable panel and gap configuration is considered within the scope of the present invention.

Figure 7:
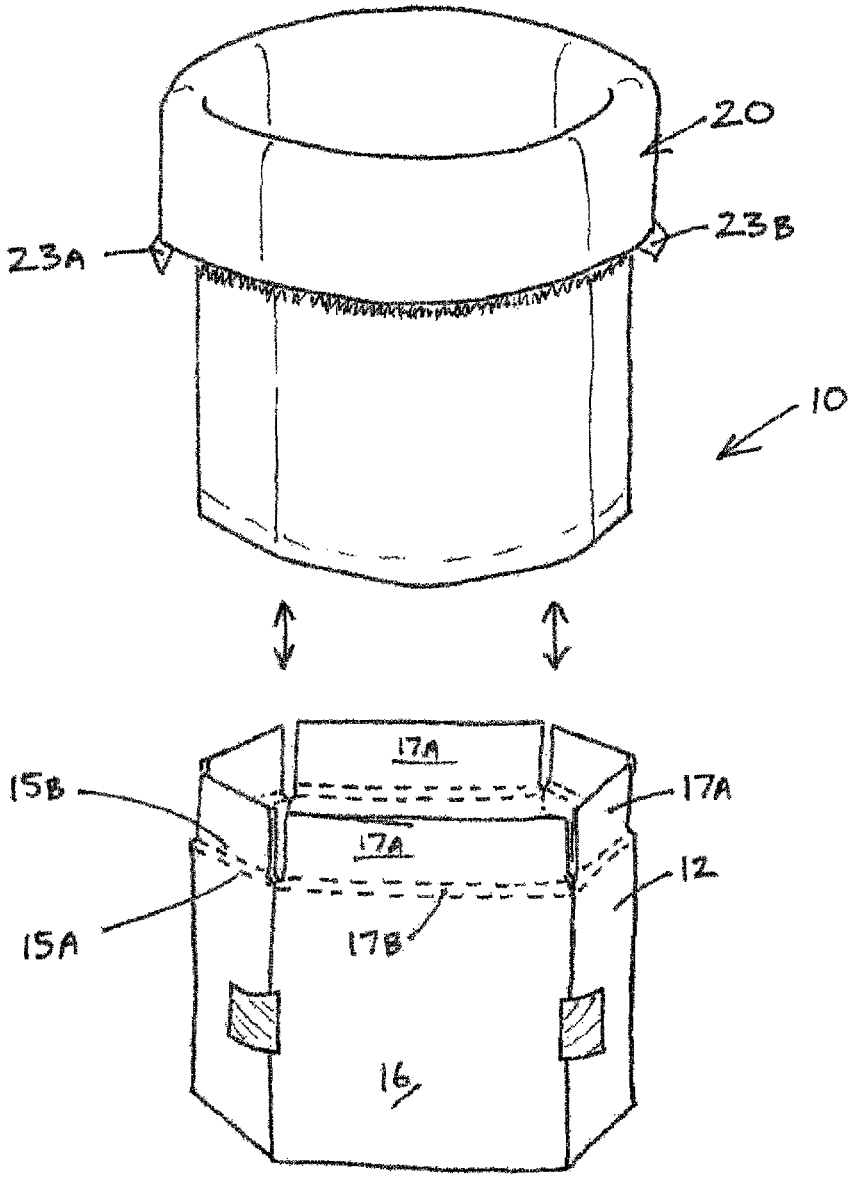
FIG. 7 is a side perspective view showing the hexagonal support structure with the liner in exploded relation therewith.
Figure 8:
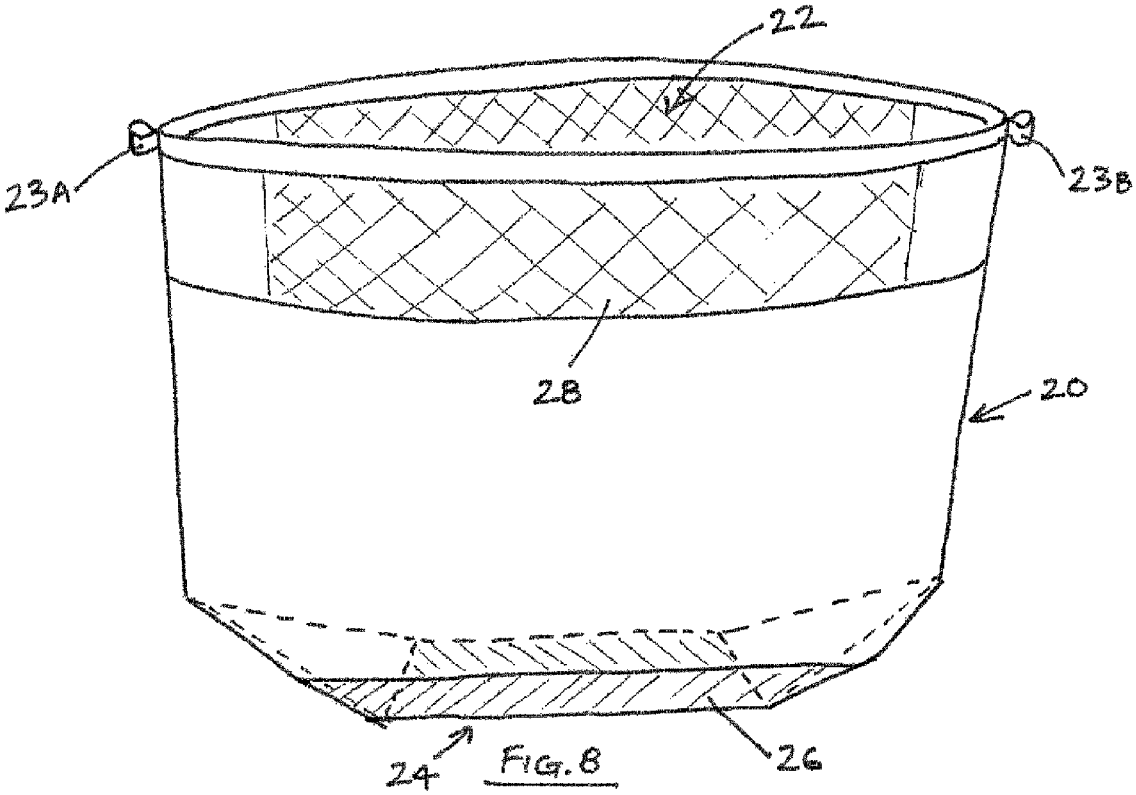
FIG. 8 is a perspective view of the liner.
Figure 9:
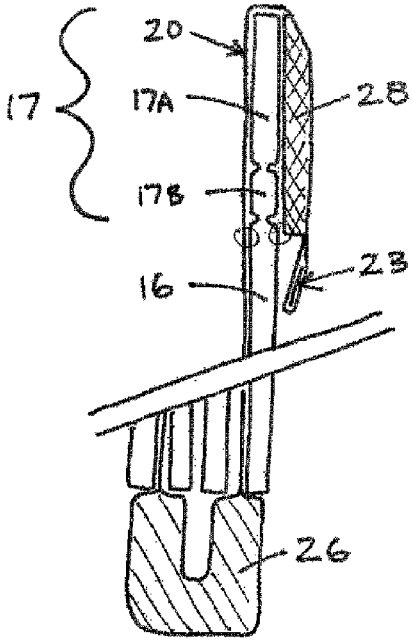
FIGS. 9 and 10 are partial side sectional views of the liner and support structure illustrating the rim formation.
Figure 10:
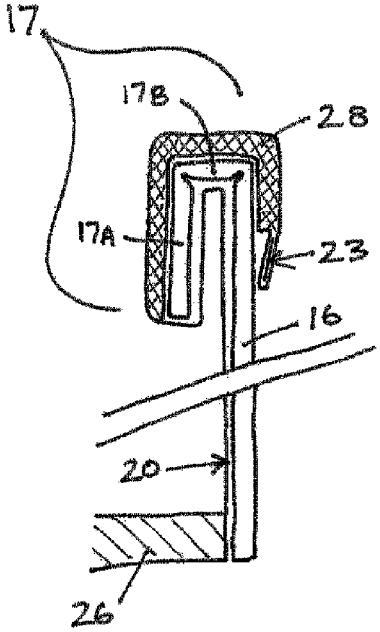

FIG. 7 shows a liner, generally referenced as 20, shown in exploded relation with stock material 12 configured in an expanded hexagonal support structure configuration in accordance with the present invention. As best seen in FIG. 8, liner 20 is generally cylindrical having an open top 22 and a closed bottom 24. Top 22 is adapted with drawstrings, referenced as 23, each drawstring having a user accessible end, referenced as 23A and 23B respectively. Liner 20, and particularly bottom portion 24, is adapted with absorbent material 26 to provide for the absorption and retention of fluids. A further significant aspect of the present invention includes providing liner 20 with sections of padded material 28 disposed on the upper portion thereof in proximity to open top 22. Padded sections 28 are positioned so as to overlap the top rim formed when tab sections 17A and 17B are folded inward as illustrated by FIGS. 9 and 10. FIG. 9 shows liner 20 insertedly disposed within the support structure formed by foldable stock 12 in overlapping relation with fold line 15 with the device 10 in the collapsed configuration. FIG. 10 shows liner 20 insertedly disposed within the support structure formed by foldable stock 12 in overlapping relation with the top rim generally defined by the folding over of tab sections 17A and 17B with the device 10 in the expanded support structure configuration. The double wall top rim thus provides increased rigidity and strength. The positioning of padded sections 28 on liner 20 in relation to foldable stock 12 provides a padded top rim that functions to provide a comfortable seat structure when in use. More particularly, it is the combination of a double wall (e.g. thicker) top, formed by the upper edges of panel 16 and tab sections 17A and 17B, with an overlay of padding that provides a relatively comfortable top edge. In addition, providing padding in non-continuous sections is beneficial in maximizing the collapsibility of the structure as an over abundance of padding would prevent full compact collapsing thereby result in an overly bulky structure when in the collapsed configuration. As further noted above, the present invention.

Figure 11A:
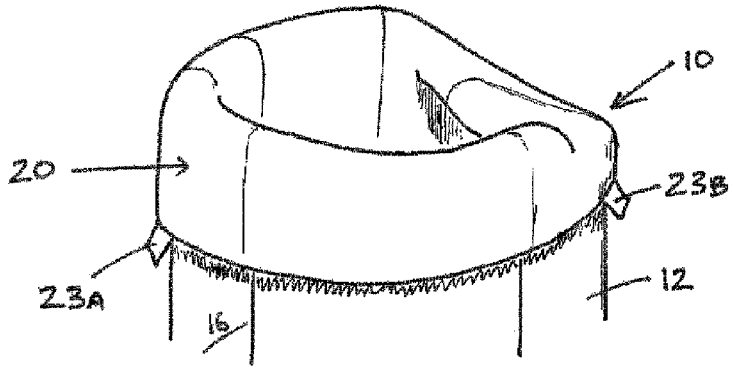
FIGS. 11A-11C are partial perspective views illustrating the folding over of the upper support structure tabs with the liner insertedly disposed within the support structure.
Figure 11B:
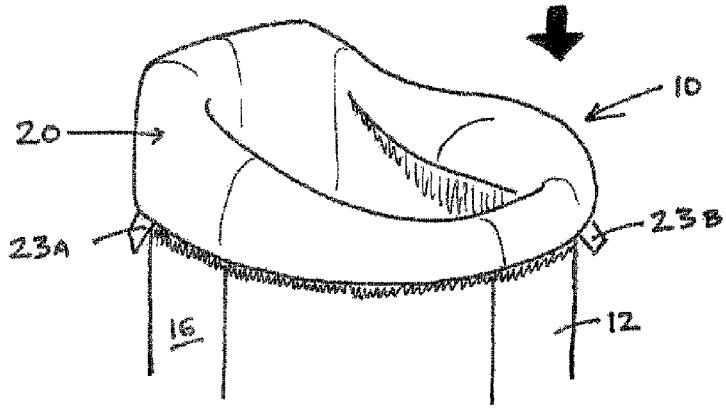
Figure 11C:
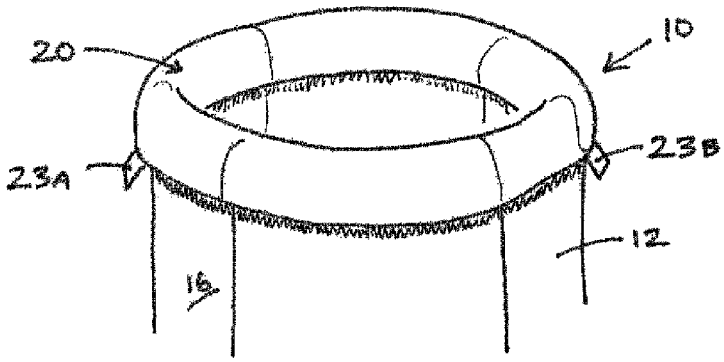

FIGS. 11A-11C are partial perspective of a portable toilet 10 in accordance with the present invention illustrating the folding over of the upper support structure tabs with liner 20 insertedly disposed. More particularly, liner 20 is inserted in generally concentric relation with support structure 12 with the upper edge portion thereof folded over thereby concealing tabs 17 as shown in FIG. 9. Tabs 17 are then sequentially folded inward along the circumferential top edge as illustrated by the sequence depicted in FIGS. 11A, 11B, and 11C, until entirely folded over so as to form the top or seat of the portable toilet 10. Portable toilet 10 may then be used in a rather conventional manner whereby the user's waste is deposited into the liner 20. As should be apparent, the support structure is sufficiently rigid to support the weight of a user sitting on the top rim. Portable toilet 10 may be fitted with a liner 20 and initially configured to a compact configuration as generally illustrated in FIG. 4 wherein the device may be temporarily secured in the compact configuration by a sacrificial tab or spot of glue (not shown).

Figure 12A:
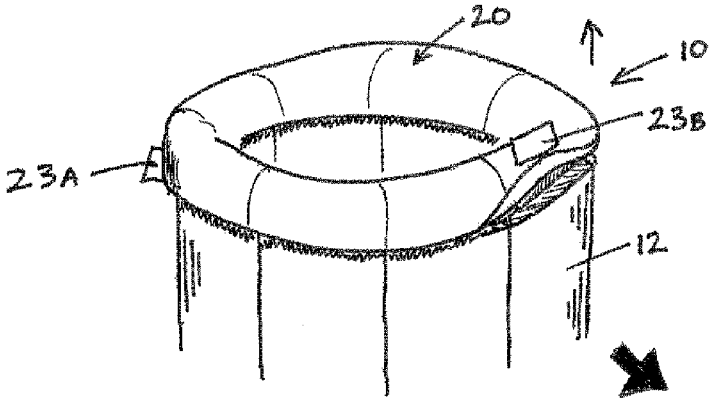
FIGS. 12A-12E are partial perspective views illustrating closure of the liner and compaction of the support structure after use.
Figure 12B:
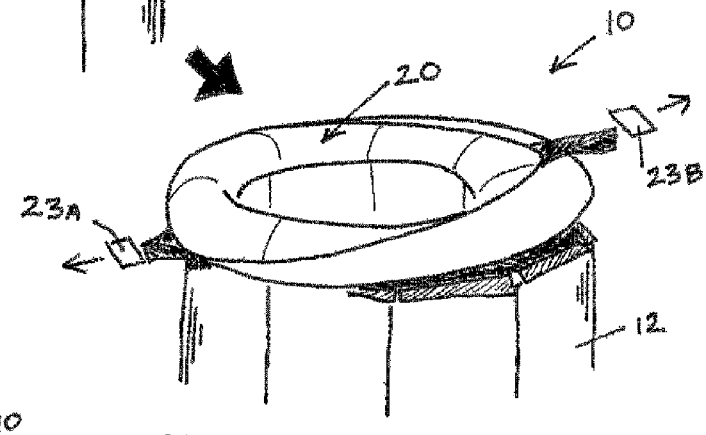
Figure 12C:
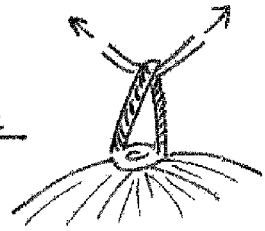
Figure 12D:
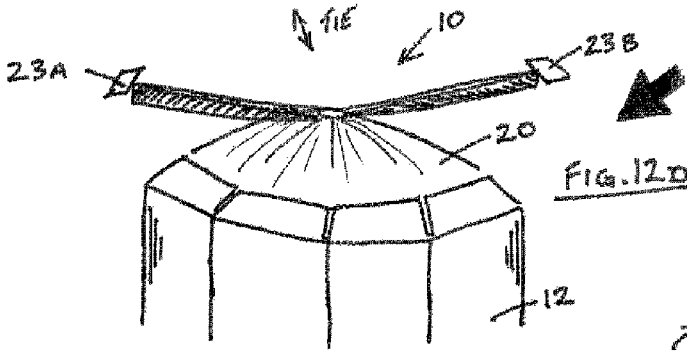
Figure 12E:
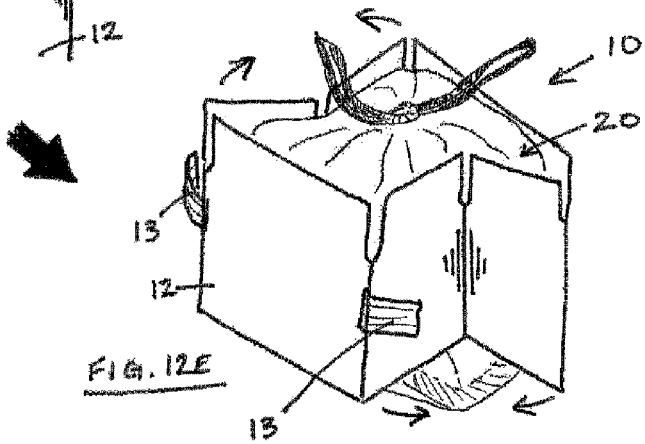

FIGS. 12A-12E are partial perspective views illustrating the post-use configuration and closure of portable toilet 10 for disposal. First, the user lifts one or both draw string ends, 23A and 23B, to release the top liner edge from support structure 12 as depicted in FIG. 12A. Next, the user pulls drawstring opposing ends 23A and 23B to close the liner top as illustrated in FIG. 12B, whereafter a closure is formed by tying the drawstring ends together as illustrated in FIGS. 12C and 12D. Finally, the support structure is preferably collapsed to a more compact configuration and secured using tabs 13 adapted with adhesive, hook and loop fastening material, or any other suitable securing means. In addition, it is noted that the provision of absorbent padding sections 28 provides an additional benefit in the closure of the liner. More particularly, as the top of the liner is drawn to a close padding sections 28 are brought closely together thereby functioning to form an absorbent closure.

Figure 13:
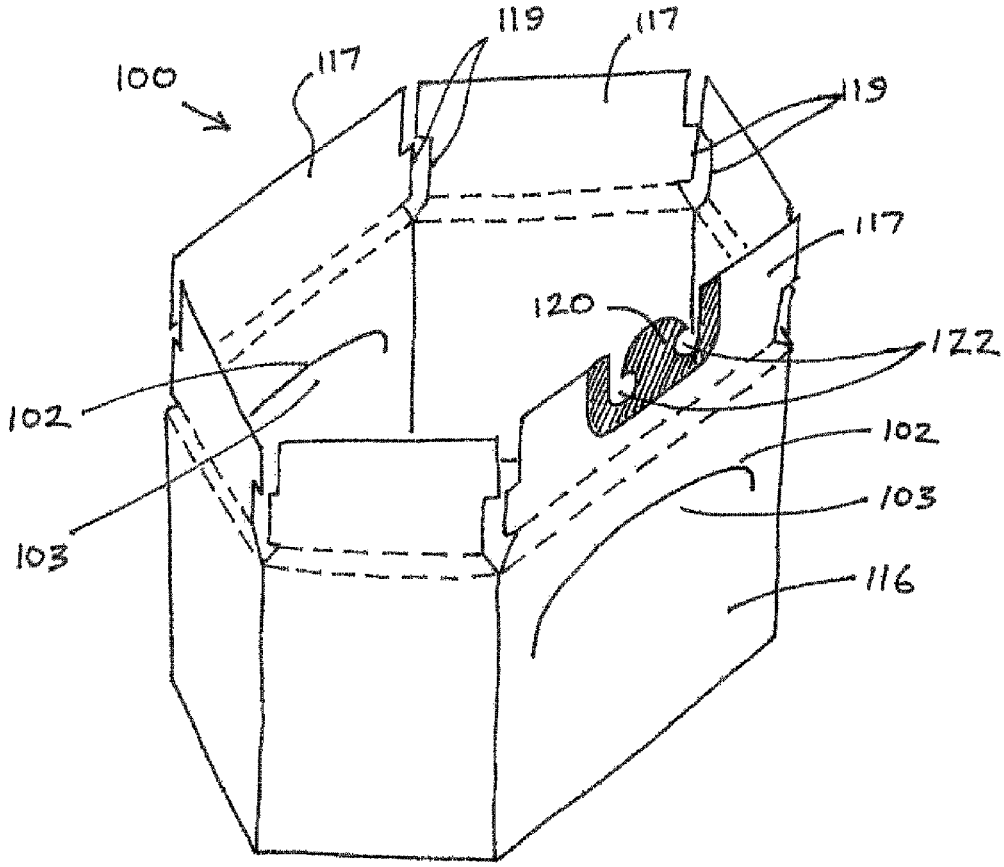
FIG. 13 is a top perspective view of an alternate embodiment support structure.
Figure 14A:
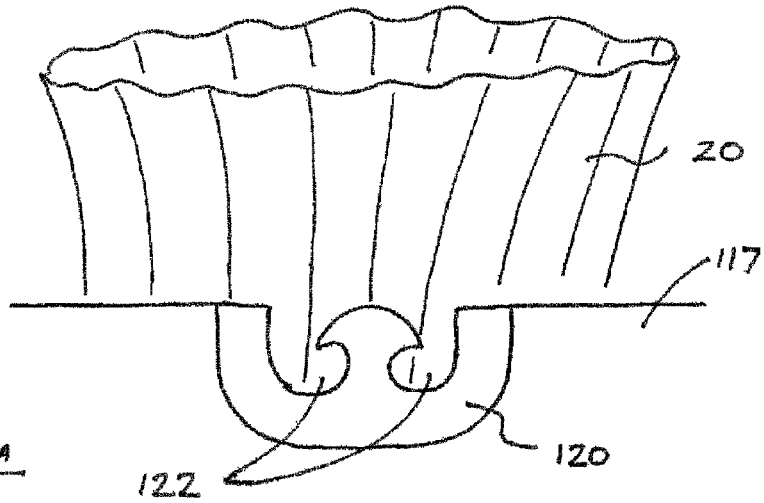
FIGS. 14A-14C provide detailed illustrations regarding the use of an improved liner tie-off structure of the present invention.
Figure 14B:
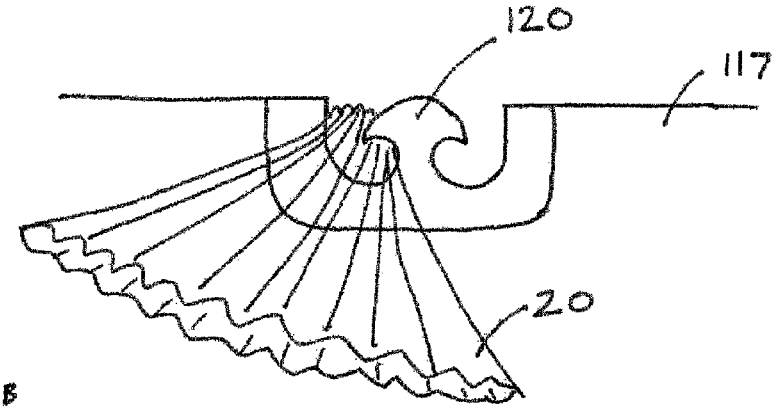
Figure 14C:
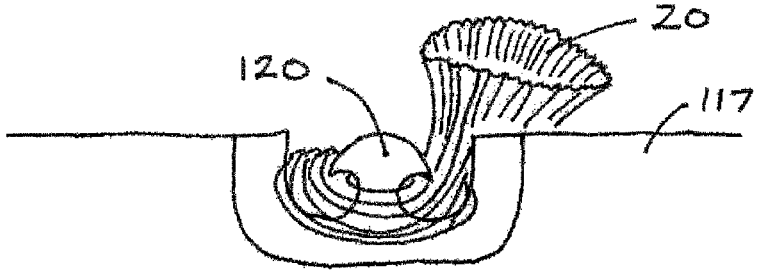

FIG. 13 depicts an alternate embodiment of a compact disposable portable toilet, generally referenced as 100, having a number of significant structural modifications. Among the structural modifications illustrated in FIG. 13 are slits 102 cut into one or more side panels 116. Slits 102 function to create flaps, referenced as 103, which may be expanded outward so as to form a gap for receiving an edge portion of the liner therein in compression fit engagement so as to assist in securing the liner relative to portable toilet 100. A further structural advantage found in the embodiment depicted in FIG. 13 relates to the formation on the edges of tabs 117 of a series of protruding and recessed structures, generally referenced as 119, which structures function to interlock adjacent tabs in the folded over configuration when in the portable toilet 10 is in use. Yet another improvement found in the embodiment shown in FIG. 13, is the formation of a liner closure structure, generally referenced as 120. Liner closure structure 120 preferably comprises a W-shaped edge portion formed on a flap 117 so as to define a pair of notches, referenced as 122 for receiving a portion of a closed liner therein in a tightly compacted, e.g. rope like form to that prevents odor from escaping. FIGS. 14A, 14B, and 14C, illustrate use of the bag closure structure 120 in relation with the top portion of a liner 20. The upper edge of the liner is first pulled upward as illustrated in FIG. 14A, pulled taught and inserted through first and second notches 122 as illustrated in FIGS. 14B and 14C whereby an improved seal is formed to prevent the spread of odor.

The present invention may further be adapted to include sanitizing wet wipes as an integral addition to the presently disclosed structure. In accordance with this embodiment, a package containing one or more sanitizing wipes is preferably affixed to, or associated with, portable toilet 10 to provide the user with sanitizing wipes for use in cleaning and maintenance of personal hygiene.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A disposable collapsible portable toilet comprising:

sheet material having a first end, a second end, and a plurality of side walls disposed between said first and second ends;

each of said side walls having a top edge, a bottom edges, and lateral edges, with adjacent side walls joined by fold lines generally aligned with said lateral edges;

each of said side walls further including a foldable tab having a distal edge projecting from the top edge thereof, each tab joined to said top edge by a first fold line and including a second fold line in parallel spaced relation with said first fold line and a rim-forming portion disposed between said first and second fold lines, and each tab spaced from adjacent tabs by a gap;

said first end connectable to said second end to form an interior volume surrounded by said side walls with said tabs projecting vertically upward;

a waste containment liner at least partially received within said interior volume, said liner having a bottom, a generally cylindrical wall projecting upward from said bottom and an upper edge portion, said upper edge portion folded over the top of said folding tab distal ends; and said sheet material and liner configurable for use with said tabs folded radially inward about said first and second fold lines such that said rim-forming portion forms a generally horizontally disposed upper rim with a portion of said liner upper edge portion in overlaying relation therewith.

2. A disposable collapsible portable toilet according to claim 1, wherein said sheet material is further configurable to a collapsed configuration by folding of said side walls about said side wall fold lines such that said interior volume is minimized.

3. A disposable collapsible portable toilet according to claim 1, wherein at least two of said side walls define a slit which function create flaps that may be expanded outward so as to form a gap for receiving an edge portion of said liner in compression fit engagement.

4. A disposable collapsible portable toilet according to claim 1, wherein at least one of said tab distal edges defining at least one notch for receiving a portion of said liner therein in a tightly compacted, generally sealed configuration to prevent the spread of odor.

5. A disposable collapsible portable toilet according to claim 1, wherein said tabs include lateral edges defining protruding and recessed structures that function to interlock adjacent tabs in the folded inward configuration when configured for use.

6. A disposable collapsible portable toilet according to claim 1, wherein said liner includes a drawstring.

* * * * *